United States Patent [19]

Vollenweider, II

[11] Patent Number: 5,014,355

[45] Date of Patent: May 14, 1991

[54] DISPOSABLE ENVIRONMENTAL CONTROL SUIT

[75] Inventor: Edward E. Vollenweider, II, Highland, Mich.

[73] Assignee: Technical Innovations, Inc., Pontiac, Mich.

[21] Appl. No.: 415,039

[22] Filed: Sep. 29, 1989

[51] Int. Cl.[5] ..... A41D 13/00

[52] U.S. Cl. ..... 2/79; 2/DIG. 1; 2/DIG. 3; 62/259.3

[58] Field of Search ..... 2/2.1 A, 2.1 R, 413, 2/69.5, 79, 270, DIG. 1, DIG. 3; 62/5, 259.3

[56] References Cited

U.S. PATENT DOCUMENTS

| | | | |
|---|---|---|---|
| 3,291,126 | 12/1966 | Messick | 62/5 X |
| 3,337,279 | 8/1967 | Reinhardt et al. | 2/270 X |
| 3,568,209 | 3/1971 | O'Neill et al. | 2/2.1 R |
| 3,777,750 | 12/1973 | Savornin | 2/2.1 R X |
| 4,146,933 | 4/1979 | Jenkins et al. | 2/DIG. 1 X |
| 4,194,247 | 3/1980 | Melander | 2/DIG. 1 X |
| 4,242,769 | 1/1981 | Rayfield et al. | 2/79 X |
| 4,271,833 | 6/1981 | Moretti | 2/DIG. 1 X |
| 4,642,819 | 2/1987 | Ales et al. | 2/270 X |
| 4,731,883 | 3/1988 | Foster | 2/DIG. 1 X |
| 4,914,752 | 4/1990 | Hinson et al. | 2/79 X |

FOREIGN PATENT DOCUMENTS

| | | | |
|---|---|---|---|
| 1155985 | 12/1957 | France | 2/DIG. 1 |
| 2515048 | 4/1983 | France | 2/DIG. 1 |

OTHER PUBLICATIONS

"Jomac" advertisement, 1 pg., Class 2/Sub 79, dated Nov. 1961.

"Conney, We're Serious About Safety", Fall 1989.

"Exair, Problem Solving Products for Industry", Catalog No. 88, Kappler Garments advertisement.

*Primary Examiner*—William A. Cuchlinski, Jr.

*Assistant Examiner*—Scott Cummings

*Attorney, Agent, or Firm*—Harness, Dickey & Pierce

[57] ABSTRACT

A disposable environmentally controlled suit. The suit includes a coverall made of an inexpensive material which is relatively non-permeable to air. Elastic closures are provided at the neck and the terminal portions of the arms and legs. A manifold is formed in the back of the suit by an inner layer and an outer layer which forms a chamber therebetween. Outlet ports are provided for release of air from the chamber into the interior of the suit. A Hilsch tube is attachable to the manifold for supplying a cooled or heated air stream to the manifold. Suspenders hold the suit off of the shoulders of the user for providing circulation of air around the shoulders. The suit inflates upon injection of air into the manifold which keeps the suit away from the body of the user. Air is allowed to escape through the elastic closures. In a controlled manner such that the entire body of the user is kept cool or warm as desired.

15 Claims, 3 Drawing Sheets

DISPOSABLE ENVIRONMENTAL CONTROL SUIT

BACKGROUND OF THE INVENTION

The present invention relates to a protective suit which is environmentally controlled such that the user may work in comfort. More particularly, the present invention relates to a disposable environmentally controlled suit.

In the industrial environment of today, workers in some industries have daily job functions which require protective clothing in order to protect the worker from hazards which may irritate or damage the clothing or skin of the worker. For instance, in modern boat building operations using fiberglass materials, it is common to have at least one worker who spends the majority of his working hours grinding and finishing fiberglass materials. While hardened fiberglass materials are not particularly hazardous or life threatening, the fibers and dusts created during working with fiberglass may tend to damage clothes and irritate the skin if they are allowed to accumulate on the clothes or skin. In other industries, workers are required to wear protective clothing when entering certain areas where hazardous materials are present. Thus, it has been common in such industries to provide disposable coverall garments for workers.

In order to perform their primary protective function, it is required that such garments be made of relatively non-permeable and inert material. In addition, it is preferable that such garments be relatively inexpensive so that they can simply be disposed of after several wearings by the worker. An example of an appropriate material for such suits is a polylaminated spun polyolefin known as a TYVEK ®, a registered trademark of du Pont, a Delaware corporation. Suits made from this material have been found to be light weight, durable, inexpensive, and relatively inert to many hazardous substances found in such working environments and therefore, are ideally suited for use in protective coveralls. However, due to the relative non-permeable nature of such material, the suits are not "breathable" which would assist in eliminating water vapor due to perspiration. Thus, while these suits do protect the workers, they are also somewhat problematic in that they generally lock in heat and moisture such that the worker becomes uncomfortable after a relatively short period of time when wearing the suit. Frequently, this requires work stoppage in order for the worker to recover from the overheated condition created. In some work environments, the worker may experience discomfort shortly after putting on the suit. At times, workers are even prone to unzipping the suit or otherwise creating holes in the suit to exhaust some of the perspiration and heat thereby defeating the protective purpose of the suit.

There have been some attempts to increase the comfort in these suits by utilizing supplied air type devices. For instance, in some extremely hazardous environments it is necessary to utilize supplied air helmets to provide suitable breathing air for the worker. Such a helmet may be provided with a Hilsch or vortex tube which injects a cooled stream of air into the helmet for breathing and for cooling the head of the worker. However, such air is generally not circulated into the body portion of the coverall for ventilating the body of the worker. Another such unit is a diffused air vest type garment which is designed to be worn underneath a protective suit and covers the torso of the worker. Such a vest, while helping to cool the immediate area around the torso, does not provide ventilation of the legs and arms of the worker. Also, because the vest is worn inside of the coverall, an air inlet must be routed into the suit or through the suit, thereby leaving an extra hole or orifice in the suit which must be sealed to prevent the entry of hazardous substances. Furthermore, because of its relatively high cost, such vests are not directly disposable should hazardous substances be deposited on the vest material or if the vest is otherwise damaged.

Thus, there is a need to provide a disposable protective suit which has an environmental control feature to provide protection and comfort to the worker.

SUMMARY OF THE INVENTION

The environmentally controlled suit of the present invention includes a coverall made of an inexpensive, disposable material which is substantially non-permeable to air. The suit has means for providing closure about the body and specifically at the terminal ends of the arms, legs and at the neck of the user. A manifold portion is provided on the back of the suit that includes an inner layer and an outer layer defining an air chamber therebetween. A Hilsch tube is operably connected to the manifold portion and is adapted to be coupled with an air supply for injecting a cold or heated air stream into the chamber of the manifold. The manifold includes air release passages for release of air injected into the chamber of the manifold into the interior of the suit. A suspender assembly is removably attached to the interior of the suit for support of the weight of the Hilsch tube to ensure free flow of air through the shoulder area of the coverall suit. The closures about the neck, arms and legs of the user enable the suit to inflate in response to continual injection of a cooled or heated air stream from the Hilsch tube and also provide a controlled exhaust of air from each of the closure points to maintain an air space between the suit and the body to facilitate air flow throughout the entire interior of the suit.

Other advantages of the present invention will be readily appreciated and understood by reference to the following description when considered in conjunction with the accompanying drawings.

BRIEF DESCRIPTION OF THE PREFERRED EMBODIMENT

Figure 1:
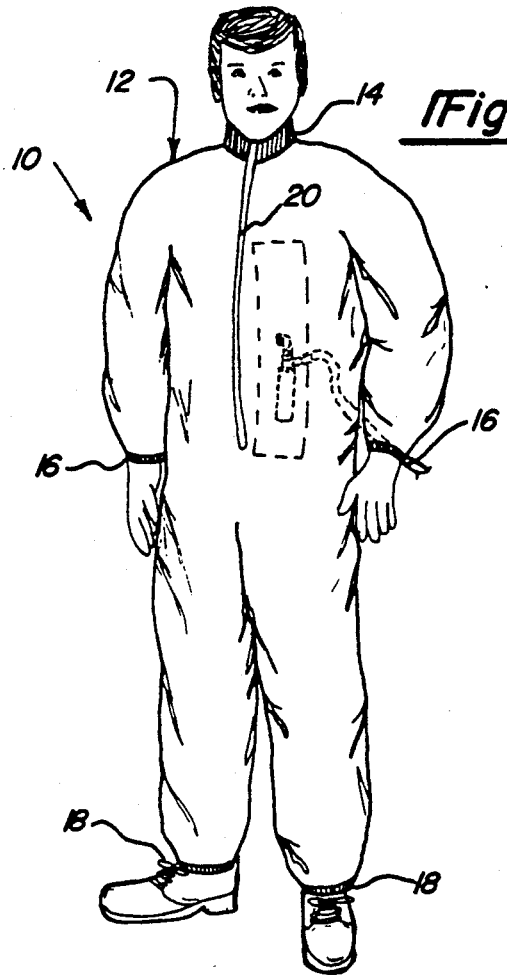
FIG. 1 is a perspective view of a worker wearing the inflated environmental control suit of the present invention.

Referring now to the drawings, an inexpensive disposable environmental control suit is generally shown at 10. The environmental control suit 10 includes a coverall portion 12 preferably made of an inexpensive disposable material which is substantially non-permeable to air. The material used in the preferred embodiment is a polylaminated spun polyolefin manufactured by du Pont under the trademark TYVEK ®. The coverall suit 12 includes closure means at the arms 16, legs 18 and neck 14. Preferably, the closure means is an elastic material, however, other types of closures could be provided which will hold the suit against the worker's appendage while allowing air above a predetermined pressure to exhaust through each of the closure means when the suit is pressurized. The coverall suit 12 also includes a zipper 20 which allows the suit to be easily put on and taken off. Optionally, an additional flap of material may be provided to prevent air leakage through the zipper 20.

Figure 2:
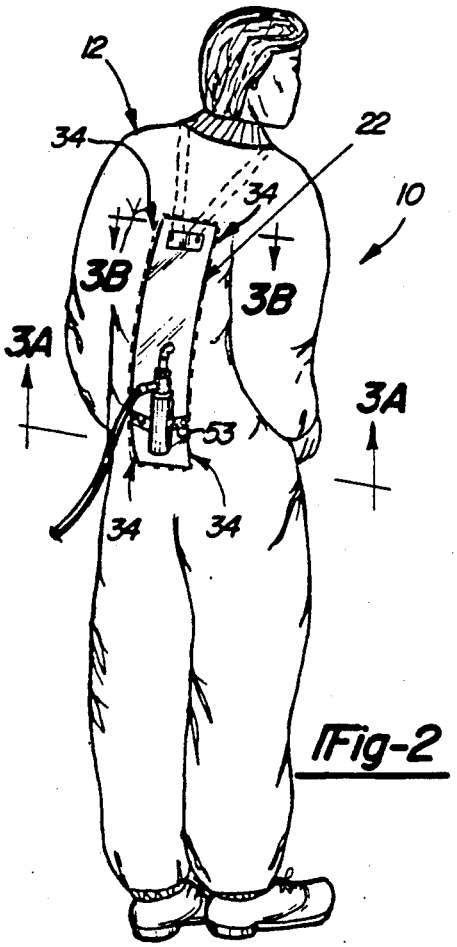
FIG. 2 is a rear perspective view showing the manifold and Hilsch tube arrangement incorporated in the environmental control suit of the present invention.
Figure 5:
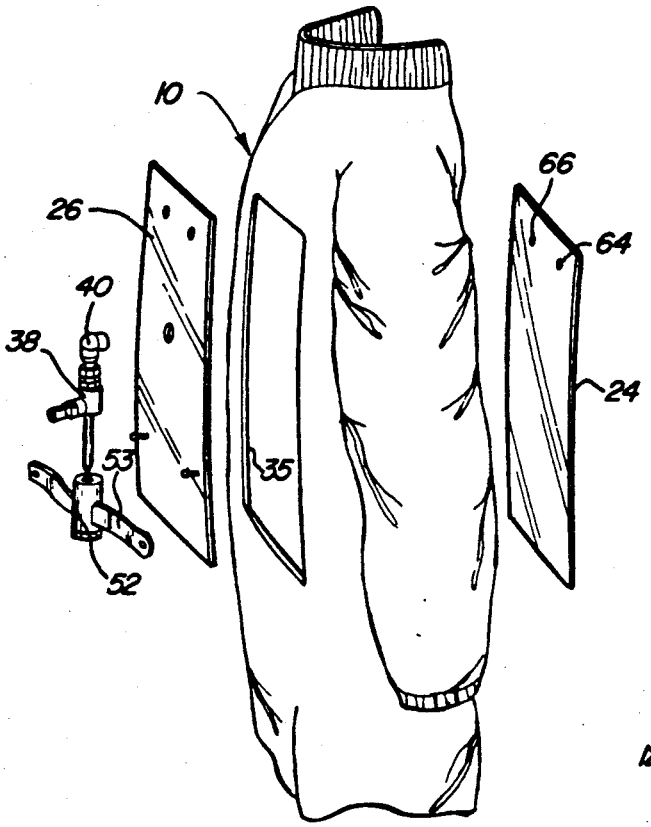
FIG. 5 is an exploded view of the manifold portion of the environmental control suit of the present invention.

A manifold 22 is provided at the back of the suit. Manifold 22 includes an inner layer 24 and an outer layer 26. In the preferred embodiment of the present invention, the inner layer and outer layer are substantially rectangular in shape and are sewn together about the peripheral edges thereof forming a rectangular seam 28. Preferably, the fabric material 30 of the coverall suit 12 is sewn between the inner and outer layer of the suit. As best shown in FIG. 5, a rectangular hole 35 is cut in the back of the suit material 30 which is smaller than the inner 24 and outer 26 layers of the manifold 22. The seam 28 is formed so as to provide a series of air release passages 32 into the interior of the suit 12. In the preferred embodiment, four air passages are provided adjacent each of the corners of the manifold 22 as indicated by the arrows 34 in FIG. 2. This may be accomplished, for instance, by initially sewing the outer layer 26 onto the suit continuously along the peripheral edge such that it is generally sealed about the edge and thereafter individually sewing on the inner layer 24 while leaving approximately one inch gaps at the position indicated by arrows 34 to provide air passages 32.

It is generally recognized that the center of the back is the heat core of the body. Thus, providing cooling or heating at the center of the back achieves the greatest degree of comfort control from the perspective of the user of the suit. The manifold 22 is therefore advantageously located to introduce cooled or heated air into the suit about the center of the back during operation of the unit. This serves to enhance the efficiency of the suit while at the same time providing an ideal location for optimizing circulation of temperature controlled air to the extremities of the suit.

The outer layer 26 of the manifold 22 includes an inlet port 36 which is adapted to be connected to a Hilsch tube 38 via a PVC fitting 40. Preferably, the outer layer 26 is also made from a PVC plastic material so that the PVC fitting 40 can be adhered to the outer layer 26 with a conventional PVC adhesive. The fitting 40 has an internally threaded end 42 which is adapted to engage the threaded end 44 of the Hilsch tube 38.

The Hilsch tube 38 is adapted to be connected via a standard compressed air fitting 48 to a source of compressed air which is supplied through hose 46. The Hilsch tube 38 is of a type which is also commonly referred to as a vortex tube and is used in industry for cooling and/or heating in industrial applications. It is common knowledge in the industry that Hilsch tubes operate to separate cool air streams from hot air streams. As an example, one theory of the operation of a Hilsch tube is as follows. Compressed air (normally 80–100 psi) is ejected tangentially through a generator into a vortex spin chamber. At more than 500,000 RPM, this air stream revolves toward the hot end where some escapes through a control valve. The remaining air, still spinning, is forced back through the center of this outer vortex. The inner stream gives off kinetic energy in the form of heat to the outer stream and exits the vortex tube as cold air. The outer stream exits the opposite end as hot air. As utilized in one manner in the present invention, hot air is exhausted at a first hot end of the Hilsch tube, as indicated by arrows 49, and cool air is exhausted into the manifold chamber 50 formed between the inner layer 24 and the outer layer 26 of the manifold. The temperature of the cool or hot air flow may be adjusted by utilizing the adjustment screw 39.

An insulating sleeve 52 is provided for shielding the suit 12 and manifold 22 from the end which tends to get heated during operation of the Hilsch tube 38. Preferably, a strap 53 is routed through slot 54 in the insulating sleeve 52 and secured to the manifold 22 by snap fasteners 55 and 56 to secure the Hilsch tube to the manifold portion 22 of the suit. This serves to support the weight of the Hilsch tube and helps prevent the connector 40 from accidentally being torn from the manifold 22 as the wearer moves about while working.

Figure 6:
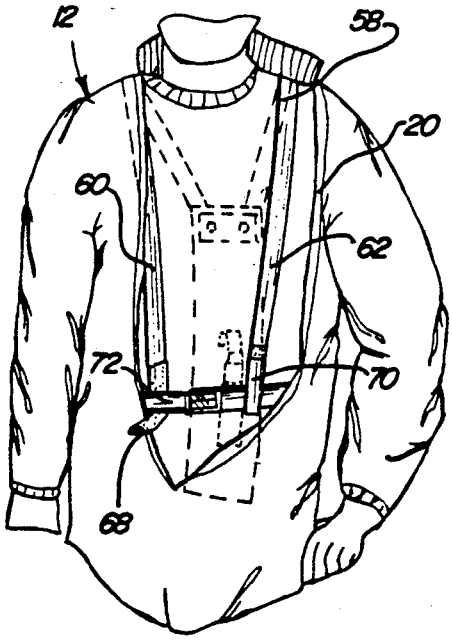
FIG. 6 is a perspective view of the suit with its zipper open showing the shoulder harness arrangement utilized in the present invention.

As best shown in FIG. 6, a shoulder harness assembly 58 is provided for keeping the suit up off the shoulders of the user during operation. Because of the weight of the hose and the Hilsch tube attached to the back of the suit, the suit, without the harness assembly 58, would have a tendency to ride on the shoulders of the user thereby constricting air flow about the shoulders. The shoulder harness arrangement of the present invention allows the weight of the Hilsch tube and attached hose to be borne by a pair of shoulder straps 60 and 62. In this manner, the suit 12 is able to inflate in the shoulder area thereby facilitating the complete circulation of air throughout the interior of the suit. The shoulder harness assembly 58 is removably attached to the suit via snaps 64 and 66 which are attached to the inner layer 24 of the manifold. The straps 60 and 62 are made of a webbing type strap material or the like and include adjustable hook and loop closures 68 and 70, such as VELCRO type closures, at the peripheral ends thereof. In operation, the shoulder harness assembly 58 is attached to the snaps 64 and 66 on the inside of the suit and the straps 60 and 62 are draped over the shoulders and secured about the belt 72 of the user via the closures 68 and 70.

Figure 3A:
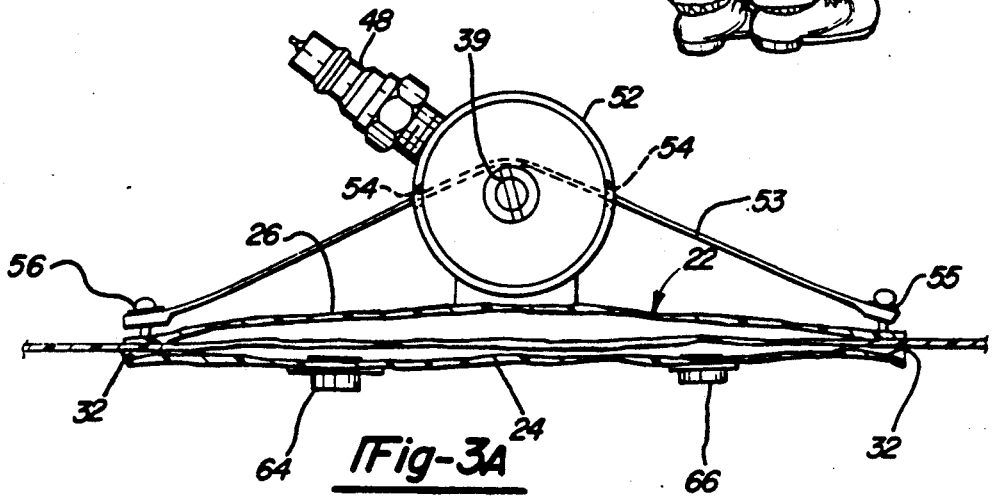
FIG. 3*a* is a sectional view taken along line 3*a*—3*a* of FIG. 2 showing the manifold and Hilsch tube of the present invention in the uninflated state.
Figure 3B:
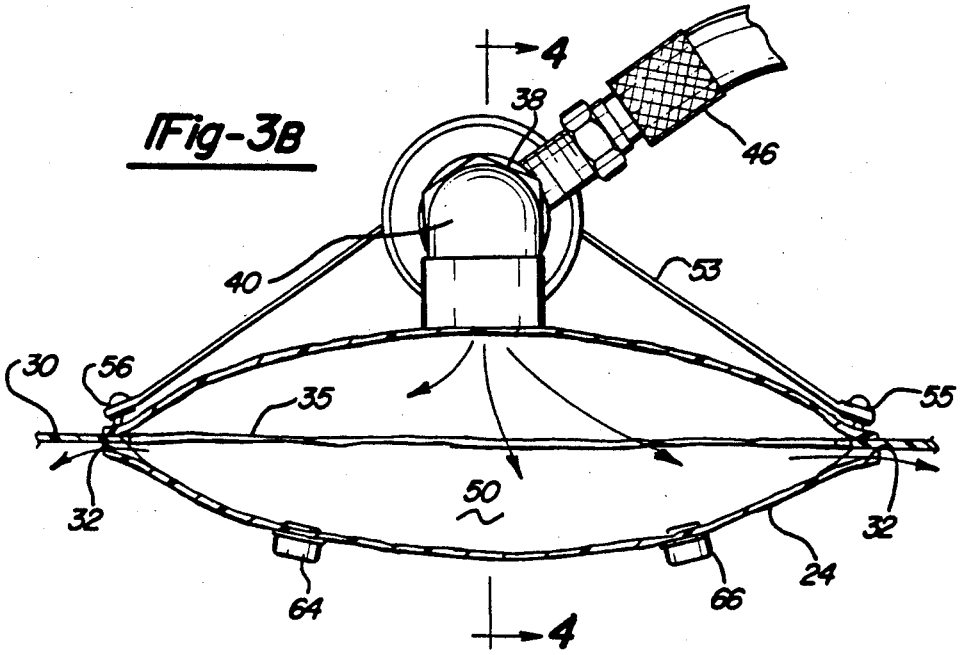
FIG. 3*b* is a sectional view taken along line 3*b*—3*b* of FIG. 2 showing the injection of air into the manifold.
Figure 4:
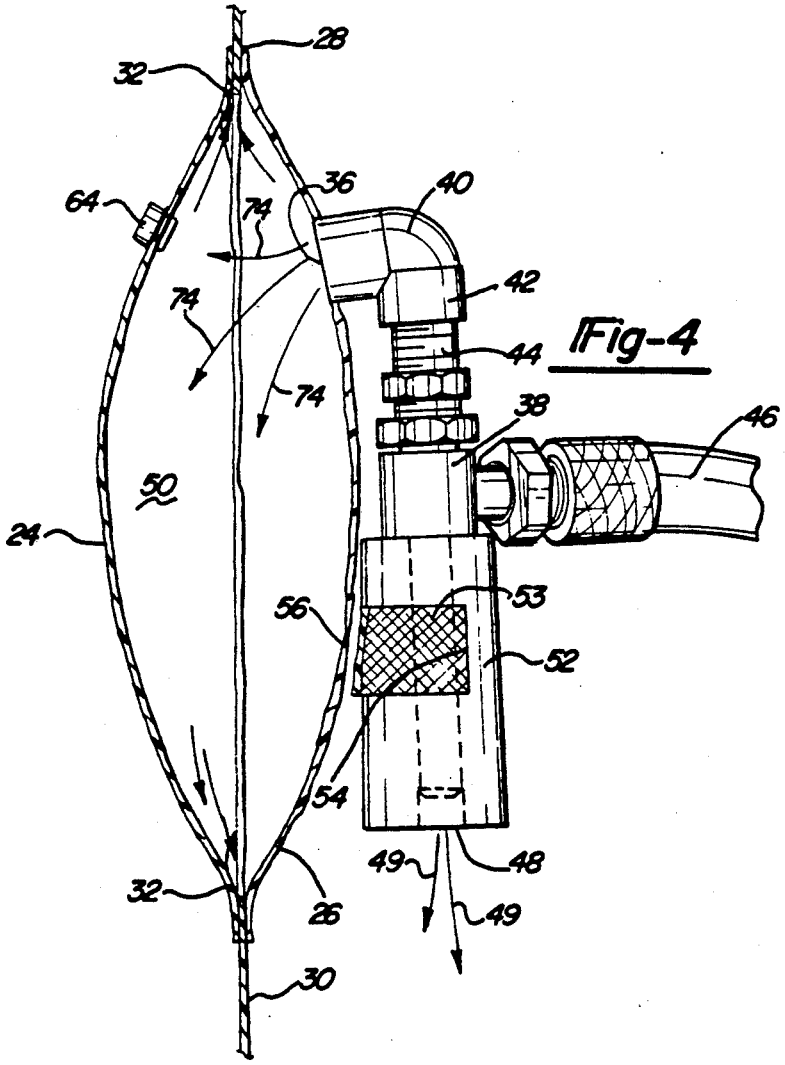
FIG. 4 is a sectional view taken along line 4—4 of FIG. 3*b* showing the inflated manifold of the present invention and the air flow therein and through the Hilsch tube utilized in the present invention.
Figure 7:
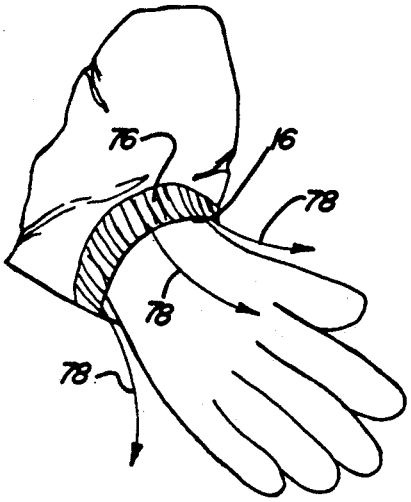
FIG. 7 is a detailed perspective view showing the air flow at a closure point in the environmental control suit of the present invention.

The suit 12 of the present invention may be utilized as shown herein by attaching the cool out flow end of the Hilsch tube 38 to blow cool air into the manifold 22 or by utilizing the hot end of the tube 38 for heating the interior of the suit 12, such as for working in coolers or freezers or the like. In the preferred embodiment, a standard compressor, capable of providing approximately 100 psi, is used to supply the compressed air to the Hilsch tube 38. In operation, the manifold portion 22 of the suit 12 expands as shown in FIGS. 3*b* and 4 to keep the back of the suit off of the user to further facilitate air flow. The air flow enters the manifold 22, as shown by arrow 74, inflates the manifold into a tube like shape, and exits the manifold through the air release passages or ports 32 into the interior of the suit. The air then inflates the suit 12 until at least a nominal positive pressure is attained, i.e. from slightly greater than zero to about 5 psi. After a nominal pressure is reached in the interior of the suit, air begins to exhaust through the peripheral ends of the suit, including the closure means about the arms 16, legs 18 and neck 14. The exiting of the air through these closure points at a predetermined flow rate is facilitated in an even manner such that the entire suit remains inflated and air circulation is sustained throughout the interior of the suit, including the arms and legs. Once a minimum inflation pressure is attained it is important that there is sufficient flow of heated or cooled air through the suit to retain inflation of the suit and to adequately ventilate the suit to remove perspiration from the interior of the suit. In the preferred embodiment heated or cooled air is exhausted through the suit at a rate of approximately 17 to about 20 CFM. Thus, for example, as shown in FIG. 7, the air flow injected into the suit will circulate through the arm portion of the suit and exit the suit by flowing under the elastic cuff 76, as shown by arrow 78. The controlled release of the air at the closure points thus allows for continual circulation of air while maintaining inflation of the suit.

While the above description constitutes the preferred embodiment of the present invention, it is to be appreciated that the invention is susceptible to modification, variation and change without departing from the proper scope and fair meaning of the accompanying claims.

What is claimed is:

1. A disposable environmental control suit comprising:

a coverall suit portion made of an inexpensive disposable material which is substantially non-permeable to air, means on said suit for providing closure at the peripheral ends of the arms and legs and also an upper extremity of the user;

a manifold portion, said manifold portion including an inner layer and an outer layer defining a chamber therebetween, said manifold portion adapted for attachment to an air supply for injecting a cooled or heated air stream into said chamber, said manifold portion including air release passages for release of air injected into said chamber from the manifold into the interior of the suit substantially approximate a central back area of a user; and a suspender means attached in the interior of the suit for support of the weight of said suit off of the shoulders of the user to ensure free flow of air through the shoulder area of said coverall suit, wherein said means for providing closure allows inflation of the suit in response to continual injection of a cooled or heated air stream, said inflation of the suit acting to hold the suit away from the skin away from the user, and said means for providing closure providing controlled release of air at said means for providing closure for maintaining said suit in the inflated position for maintaining the suit at a distance from the body and facilitating air flow throughout the entire inner periphery of the suit thereby providing circulation of air throughout the extremities of the suit without the necessity of individual air channels to the extremities of the suit.

2. The environmental control suit of claim 1 further comprising a Hilsch tube operably coupled to said manifold portion for providing a heated or cooled air supply to said suit.

3. The environmental control suit of claim 1 wherein inner layer and said outer layer are substantially rectangular in shape and are sewn together about the peripheral edges thereof and into the back of said coverall suit leaving gaps in the sewn seams produced thereby at each corner of the rectangular shape of said layers, said gaps being for fluid connection between said chamber and the interior of said suit.

4. The environmental control suit of claim 3 wherein said inner and outer layers are sewn together with a layer of suit material therebetween at the seam thereof.

5. The environmental control suit of claim 3 wherein at least said outer layer is made of PVC flexible plastic sheet.

6. The environmental control suit of claim 1 wherein said suspender means is removable for reuse in a suit of like configuration.

7. A disposable environmental control suit comprising:

a coverall suit portion, said coverall suit portion being made of an inexpensive disposable material which is substantially without the necessity of individual air channels to the extremities of the suit.

8. The environmental control suit of claim 7 wherein said suspender means further comprises a pair of straps removably attached to said inner layer, said straps including velcro adjustment portions at the ends thereof and said straps being draping over the shoulders of a user and securing about a belt of a user for providing said support of said Hilsch tube and providing ventilation about the shoulders of said suit.

9. The environmental control suit of claim 7 wherein said inner layer is of a rectangular shape and said plurality of outlet ports further comprises four of said outlet ports located at the corners of said rectangular shape.

10. The environmental control suit of claim 7 wherein said Hilsch tube includes a cooled air outlet end and an elongated hot air outlet end; said environmental control suit further including an insulated sleeve for engagement about said hot air outlet end of said Hilsch tube for protection of said suit against damages from contact with said hot air outlet end, said insulated sleeve including a means for removable securement to said outer layer of said manifold.

11. An environmental control coverall suit that is made from a substantially non-permeable material, comprising:

a manifold located on the backside of said suit and having inlet means for receiving air flow and outlet means for injecting air flow into the interior of said suit at a location about the central back area of the suit;

a Hilsch tube adapted to be connected to a source of compressed air and coupled to said inlet means of said manifold for selectively supplying hot or cold air flow to said manifold; and closure means located around the neck of the suit and at the terminal ends of the arms and legs of the suit for enabling a pressure buildup within said suit so as to inflate the suit to hold the suit off from the skin of the use, and providing for continued inflation of the suit at a predetermined flow rate through said closure means of said suit to facilitate the complete circulation of air throughout the interior of the suit and further for permitting the controlled escape of air from said suit thereby providing circulation of air throughout the extremities of the suit without the necessity of individual air channels to the extremities of the suit.

12. The environmental control suit of claim 11 further including shoulder support means connected to said manifold and adapted for placement over the shoulders of the user for supporting the weight of the Hilsch tube on the shoulders of the user, thereby facilitating the circulation of air around the shoulders of the user.

13. The environmental control suit of claim 12 further including attachment means for securing the Hilsch tube to the backside of said suit.

14. The environmental control suit of claim 11 wherein said closure means comprises an elastic material adapted to snugly fit around the neck, wrists and ankles of the user.

15. The environmental control suit of claim 11 wherein said manifold comprises an inner and an outer layer that define a chamber that is adapted to inflate upon the injection of air from said Hilsch tube.

* * * * *

UNITED STATES PATENT AND TRADEMARK OFFICE

CERTIFICATE OF CORRECTION

PATENT NO. : 5,014,355

DATED : May 14, 1991

INVENTOR(S) : Edward E. Vollenweider, II

It is certified that error appears in the above-identified patent and that said Letters Patent is hereby corrected as shown below:

Column 6, line 29, claim 7, after "substantially", insert --non-permeable to air, said suit having expandable closures at the peripheral ends of the arms, legs and at the neck portion for providing expandable engagement about the arms, legs and neck of a person;

a manifold portion positioned in the back of said coverall suit portion, said manifold portion including an inner layer sewn to an outer layer attached to said coverall suit for forming a manifold chamber, said inner layer including a plurality of air outlet ports for releasing air at a location of a central back area of a user of the suit, said outlets being formed in the seam during sewing of the inner layer to said outer layer, said outer layer including an air inlet port;

a Hilsch tube operably coupled to said air inlet port and being adapted for connection to an air supply, said Hilsch tube for supplying a cooled or heated air stream into said manifold and through said outlet ports into the interior of said suit at a location approximate the central back area of a user; and a suspender means attached to said inner layer of said manifold for supporting the weight of said Hilsch tube and for retaining said suit off the shoulders of the person wearing the suit, said suspender means ensuring air flow about the shoulder of a user, wherein said suit is inflatable upon introduction of air from said Hilsch tube into said manifold and into said suit for inflating of the suit and said expandable closures allowing controlled release of air through said expandable closures for allowing ventilation through said closures thereby providing circulation of air through the extremities of the suit--.

UNITED STATES PATENT AND TRADEMARK OFFICE

CERTIFICATE OF CORRECTION

PATENT NO. : 5,014,355

DATED : May 14, 1991

INVENTOR(S) : Edward E. Vollenweider, II

It is certified that error appears in the above-identified patent and that said Letters Patent is hereby corrected as shown below:

Column 6, line 68, claim 11, "use" should be --user--.

Signed and Sealed this

Twenty-ninth Day of September, 1992

*Attest:*

DOUGLAS B. COMER

*Attesting Officer*

*Acting Commissioner of Patents and Trademarks*